US005951904A

United States Patent [19]

Jung et al.

[11] Patent Number: 5,951,904

[45] Date of Patent: Sep. 14, 1999

[54] DUAL HALF-BRIDGE TYPE INDUCTION COOKING APPARATUS FOR MULTI-OUTPUT CONTROL

[75] Inventors: Yong-chae Jung; Sung-jin Han; Hyo-sik Jeon, all of Kwangmyung, Rep. of Korea

[73] Assignee: LG Electronics, Inc., Seoul, Rep. of Korea

[21] Appl. No.: 08/865,351

[22] Filed: May 29, 1997

[51] Int. Cl.[6] ..... H05B 6/12

[52] U.S. Cl. ..... 219/626

[58] Field of Search ..... 219/626, 661, 219/662, 663

[56] References Cited

U.S. PATENT DOCUMENTS

| | | | |
|---|---|---|---|
| 3,806,688 | 4/1974 | MacKenzie et al. | 219/626 |
| 4,549,056 | 10/1985 | Okatsuka et al. | 219/626 |
| 4,820,891 | 4/1989 | Tanaka et al. | 219/626 |
| 5,329,100 | 7/1994 | Lee et al. | 219/626 |
| 5,536,920 | 7/1996 | Kwon et al. | 219/663 |

FOREIGN PATENT DOCUMENTS

| | | | |
|---|---|---|---|
| 0583519 | 2/1994 | European Pat. Off. . | |
| 403122991 | 5/1991 | Japan | 219/626 |
| 405021150 | 1/1993 | Japan | 219/626 |

*Primary Examiner*—Teresa Walberg
*Assistant Examiner*—Jeffrey Pwu

[57] ABSTRACT

The induction cooking apparatus includes an input filter for filtering supplied power, a first inverter module having a first working coil, a second inverter module having a second working coil, and a common switching section. The common switching section and the first and second inverter modules are connected in series with the input filter, and the first and second inverter modules operate cooperatively with the common switching section to energize the first and second working coils.

11 Claims, 10 Drawing Sheets

DUAL HALF-BRIDGE TYPE INDUCTION COOKING APPARATUS FOR MULTI-OUTPUT CONTROL

BACKGROUND OF THE INVENTION

1. Field of the Invention

The present invention relates to an electromagnetic induction heater device. In particular, the present invention relates to a dual half-bridge type induction cooking apparatus for multi-output control which can minimize the construction of a circuit by constructing an inverter circuit having a plurality of inverter-modules and can remove interference noise generated when a plurality of heating plates are heated.

2. Description of the Prior Art

In a conventional induction cooking apparatus, a plurality of inverter circuits are coupled in parallel to an input power to operate a plurality of working coils.

Specifically, the conventional induction cooking apparatus, as shown in FIG. 1, includes a power supply section 1. The apparatus also includes a plurality of rectifying sections 2 for rectifying an AC power supplied from the power supply section 1, a plurality of input filters for smoothing the rectified powers, respectively. Each input filter includes a choke coil L1 and a capacitor C1, respectively. The apparatus also includes a plurality of inverter circuits 3 for respectively switching the smoothed powers provided from the input filters and for heating the heating plates.

The inverter circuit 3, for example, comprises switching transistors Q1 and Q2 for perforrning a switching operation according to switching control signals provided from a control section (not illustrated) to their bases, respectively, diodes D1 and D2 respectively connected in parallel to the transistors Q1 and Q2, and a resonance capacitor C2 for resonating with a working coil Lr1 in response to the switching operation of the transistors Q1 and Q2. The working coil Lr1 resonates with the capacitor C2, and heats the heating plate by induction heating.

According to the conventional induction cooking apparatus as constructed above, a plurality of inverter circuits are used to heat a plurality of heating plates. Specifically, n inverter circuits 3, 3-1, 3-2, . . . , 3-n are connected in parallel to the power supply section 1 to operate a plurality of working coils Lr1, Lr2, . . . Lrn.

The heating operation of the conventional induction cooking apparatus will now be explained in detail.

The AC power from the power supply section 1 is rectified by the rectifying section 2, and the rectified power is then applied to the inverter circuit 3 through the input filter composed of the choke coil L1 and the capacitor C1.

The transistors Q1 and Q2 in the inverter circuit 3 switch the current flowing through the working coil Lr1, causing food on the heating plate to be heated.

At this time, the transistors Q1 and Q2 receive the switching control signals from the control section (not illustrated) in a proper timing, and thus perform the switching operation with respect to the current flowing through the working coil.

Specifically, the transistor Q2 is turned on by the switching control signal initially provided from the control section to its base, while the transistor Q1 is turned off. Accordingly, the power supplied through the rectifying section 2 to the transistor Q2 flows through the working coil Lr1 to form a current loop, and this causes the working coil Lr1 and the capacitor C2 to resonate together.

Thereafter, the transistor Q1 is turned on by providing the switching control signal from the control section to its base, and thus the transistor Q2 is turned off. Accordingly, as the transistor Q1 is turned on, an inverse current caused by the current energy accumulated in the working coil Lr1 flows through the transistor Q1 to form a closed loop, and thus causes the current to flow through the working coil Lr1.

By repeating the switching operation as described above, the energy induced in the working coil Lr1 is transferred to the heating plate adjacent to the working coil Lr1, and heats the heating plate. At this time, the power is controlled by controlling the current flowing through the working coil Lr1 in accordance with the change of the switching frequency of the transistors Q1 and Q2.

As a result, the respective inverter circuits 3, 3-1, . . . , 3-n heat the respective heating plates through the respective working coils. The control of the output power of the respective inverter circuits is performed by frequency control as described above.

However, the conventional induction cooking apparatus has the drawback in that an accurate output control of the working coil cannot be achieved because of the interference noise caused by the operating frequency difference between the adjacent working coils. Further, because inverters, rectifiers, and input filters equal in number to the number of working coils are required, the overall circuitry is complicated, resulting in an increase in manufacturing cost.

SUMMARY OF THE INVENTION

It is an object of the present invention to provide a half-bridge type induction cooking apparatus which can solve the problems involved in the prior art.

It is another object of the present invention to provide a half-bridge type induction cooking apparatus which can minimize the construction of a circuit by constructing an inverter circuit having a plurality of inverter modules and can remove interference noise generated between adjacent coils by controlling the output through time-sharing control.

BRIEF DESCRIPTION OF THE DRAWINGS

The above objects, other features, and advantages of the present invention will become more apparent by describing the preferred embodiments thereof with reference to the accompanying drawings in which.

DETAILED DESCRIPTION OF THE PREFERRED EMBODIMENTS

Figure 1:
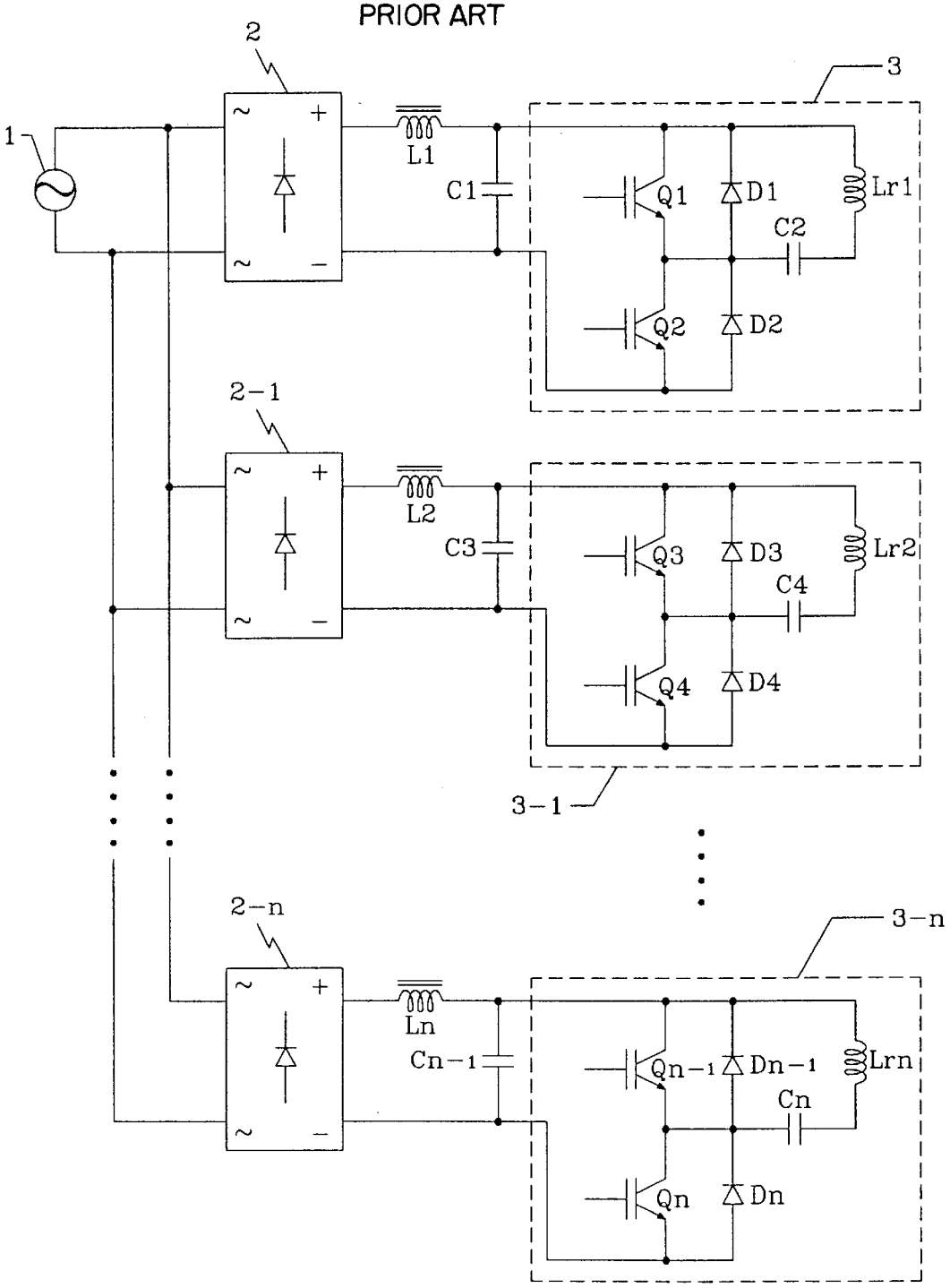
FIG. 1 PRIOR ART
FIG. 1 is a schematic circuit diagram of a conventional induction cooking apparatus.
Figure 2:
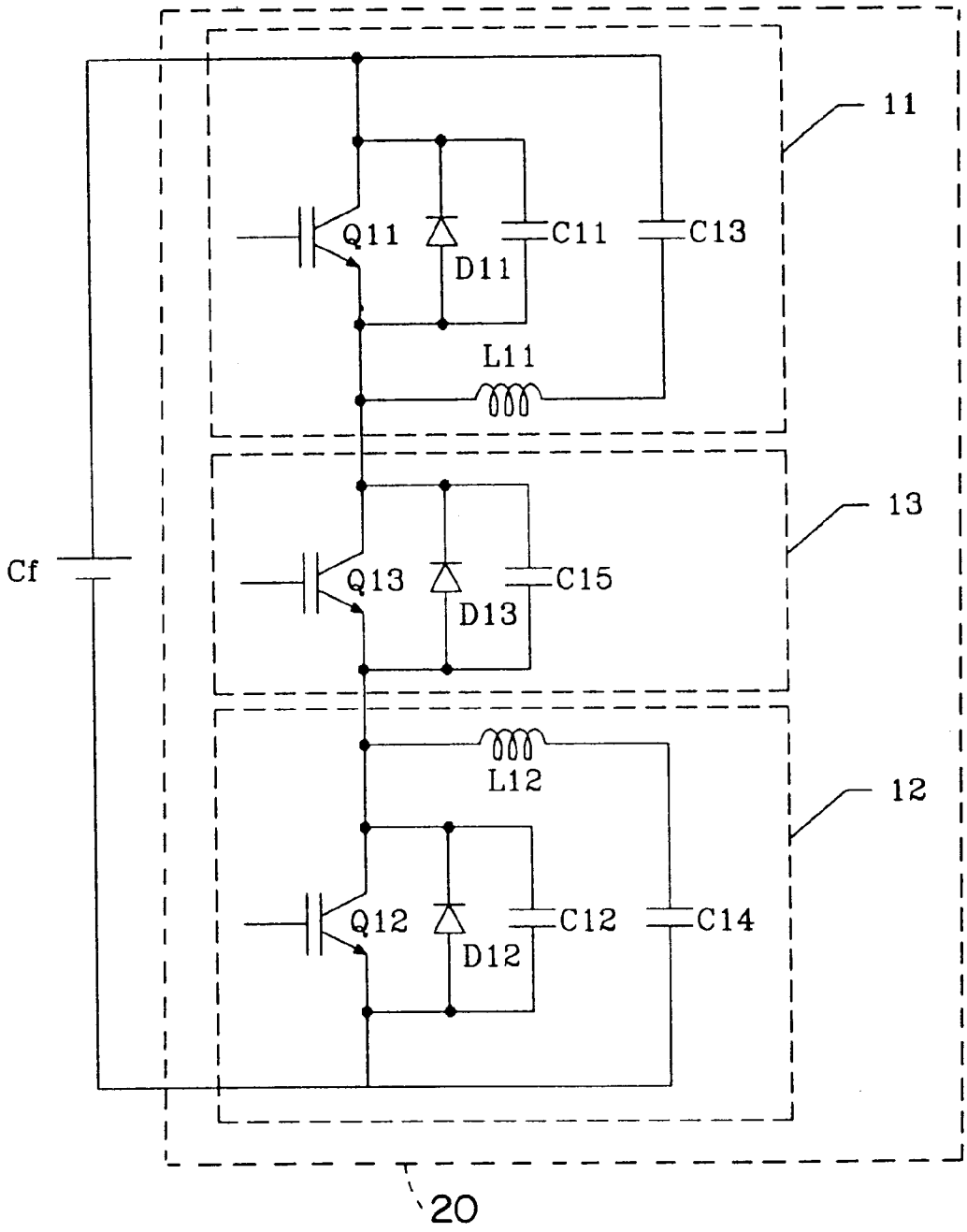
FIG. 2 is a schematic circuit diagram of the dual half-bridge type induction cooking apparatus for multi-output control according to a first embodiment of the present invention.

FIG. 2 is a schematic circuit diagram according to the first embodiment of the present invention.

Referring to FIG. 2, the induction cooking apparatus according to the first embodiment includes an input filter capacity Cf for increasing the inverse ratio of the supplied power and inverter modules 11 and 12. The inverter modules 11 and 12 are coupled in series with the input filter capacity Cf and have a common switching section 13. This structure forms a half-bridge type inverter circuit 20 for multi-output control.

The inverter modules 11 and 12 have the same construction and include transistors Q11 and Q12, respectively, for switching the power supplied separately. Diodes D11 and D12 connected to the transistors Q11 and Q12 in reverse parallel, auxiliary resonance capacitors C11 and C12 connected to the transistors Q11 and Q12 in parallel with the diodes D11 and D12, main resonance capacitors C13 and C14, and working coils L11 and L12 for heating the heating plates by resonating with the capacitors C13 and C14 are also part of the inverter modules 11 and 12, respectively.

The switching section 13 includes transistor Q13 for performing a switching operation according to the switching control signals provided from the control section (not shown), diode D13 connected to the transistor Q13 in parallel and auxiliary resonance capacity C15 connected to the transistor Q13 in parallel.

According to the dual half-bridge type induction cooking apparatus of the first embodiment, the inverter modules 11 and 12 are connected in series with common switching section 13 to form the half-bridge. Such an inverter circuit operates two working coils L11 and L12 through time-sharing control and heats two heating plates.

Generally, the operation of the Single Ended Push-Pull (SEPP) or half-bridge inverter is divided into two modes: a below resonance mode and an above resonance mode.

The below resonance mode is operation at a switching frequency lower than the L, C resonance frequency and the above resonance mode is operation at a switching frequency higher than the L, C resonance frequency.

In case of the below resonance mode, the switch section 13 is turned off in 0 current state. However, when the switch section 13 is turned on, the capacity of the diode is decreased due to the reverse recovering current, and EMI is increased. Noise may occur since the maximum output occurs from the maximum frequency.

On the other hand, in case of the above resonance mode, there is some loss when the switch section 13 is turned off. However, when the switch section 13 is turned on, there are no drawbacks as described above since it operates under the 0 voltage condition.

Thus, the above resonance mode is generally used. The present invention uses the half-bridge type inverter which is operated using the above resonance mode and has the common switching element 13 to minimize the circuit construction.

The operation of the dual half-bridge type induction cooking apparatus for multi-output control according to the present invention will be explained with reference to FIGS. 3A and 3B.

Figure 3A:
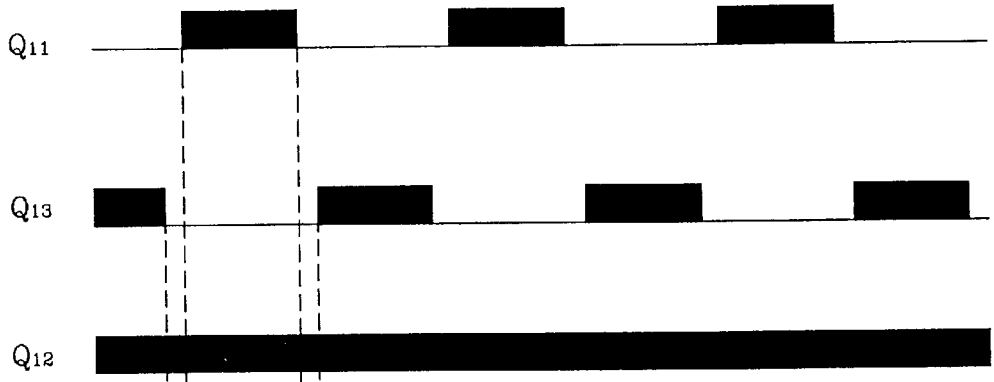
FIG. 3A illustrates the on/off switching waveform of the switching elements in FIG. 2 when the working coil L11 operates.

When the working coil L11 operates, the switch section 13 is controlled as shown in FIG. 3A. Then, the half-bridge type inverter is constructed by operating the inverter module 11 and the switch 13 together.

The working coil L11, the capacity C13 and auxiliary resonance capacitors C11 and C15 resonate if the transistor Q12 of the inverter module 12 is turned on and the transistor Q13 is turned off.

Thereafter, if the voltage of the auxiliary resonance capacity C11 drops to "0"V, the diode D11 operates and the main resonance capacitor C13 and working coil L11 resonate continuously through the diode D11.

At this time, the transistor Q11 is turned on, causing the capacitor C13 and working coil L11 to resonate through the transistor Q11 in a reverse current direction.

After continuously resonating for a certain time, the transistor Q11 is turned off, causing the capacity C13, the working coil L11 and auxiliary resonance capacitor C11 and C15 to resonate.

When the voltage of the auxiliary resonance capacity C15 becomes "0"V, the diode D13 connected to the transistor Q13 in a reverse parallel operates, the working coil L11 and the capacitor C13 resonate through the diode D13 and transistor Q13 is turned on. When the transistor Q13 is turned on, the capacitor C13 and working coil L11 resonate again.

Thereafter, if the direction of the current is changed and a certain time is passed after continuous resonance, a period 1T is completed. When the transistor Q13 is turned off, the auxiliary resonance capacitors C11 and C15, the capacitor C13 and the working coil L11 resonate again.

By repeating the above-described operation, the current of the working coil L11 is varied in a constant sine waveform.

In the meantime, another working coil L12 operates in an identical manner to the working coil L11, but alternately with the operation of the working coil L11. Referring to FIG. 3B, the operation of the working coil L12 will now be explained.

The half-bridge type inverter is constricted as the inverter module 12 and the switching section 13 operate together.

If the transistor Q11 of the inverter module 11 is continuously turned on and the transistor Q13 is turned on, the capacitor C14 and the working coil L12 resonate through the transistor Q13.

When the transistor Q13 is turned off after the above-described resonance progresses, the capacitor C14, the working coil L12 and the auxiliary resonance capacitor C12 and C15 resonate together.

At this time, if the voltage of the auxiliary resonance capacitor C12 drops to a "0"V, the working coil L12 and the capacitor C14 resonate through the diode D12 and the current of the working coil L12 decreases.

As described above, if the transistor Q12 is turned on, the direction of the current is changed and the capacitor C14 and the working coil L12 resonate through the transistor Q12.

If the direction of the current is changed and the resonance progresses for a certain time, the transistor Q12 is turned off.

When the transistor Q12 is turned off, the auxiliary resonance capacitor C12 and C15, capacitor C14 and the working coil L12 resonate again for a short time, causing the voltage of the capacitor C15 to drop to "0"V.

The current of the working coil L12 flows to the diode D13 connected to the transistor Q13 and thus, the current of the working coil L12 decreases linearly through the diode D13. At this time, if the transistor Q13 is turned on again, a period 1T is completed.

As describe above, the current flows to the diode connected to each switching element based on whether the switching element is on or off according to the predetermined frequency. In this case, the on times are identical. Thus, the dual half-bridge type induction cooking apparatus for multi-output control operates.

Further, when one switching element is turned on, another switching element is turned off, and the time for resonance of the auxiliary resonance capacitor and the switching element is obtained since the time when two switching elements are turned off (i.e., dead time) exists.

The dead time exists for a very short time because the auxiliary resonance capacitor is smaller, more than ten times smaller, than the main resonance capacitor.

As described above, two working coils are operated by the half-bridge type inverter consisting of two inverter modules having a common switching element and the output control of each module which constructs each half-bridge type inverter is made by the time-shared control (i.e., alternately energizing the working coil associated with each inverter module 11, 12). Thus, no interference noise is generated between working coils because two working coils do not operate simultaneously.

Figure 4:
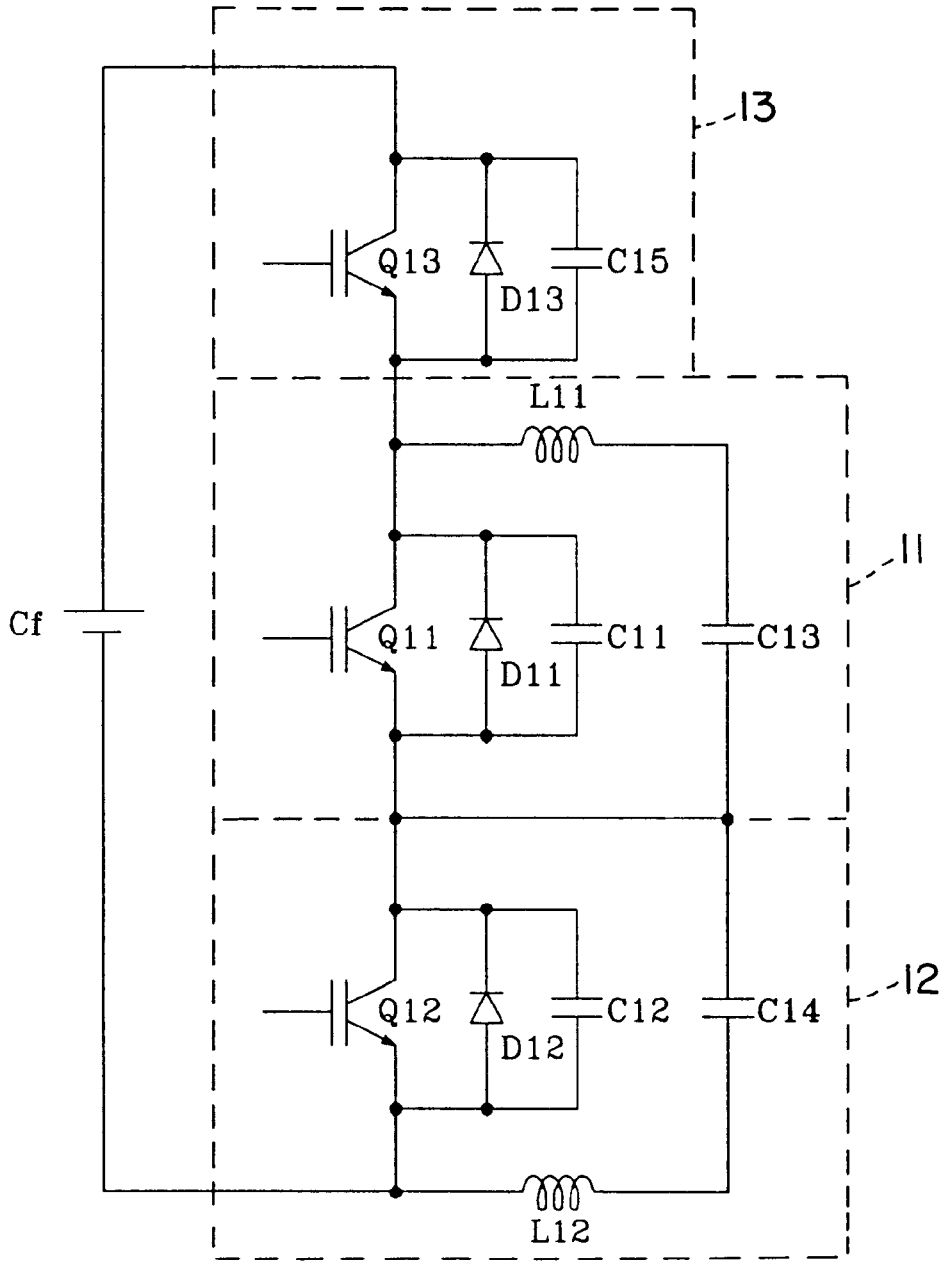
FIG. 4 is a schematic circuit diagram according to the second embodiment of the present invention.

FIG. 4 is a circuit diagram of the second embodiment according to the present invention. In the second embodiment, the switching section 13 is directly connected to the input filter capacitor Cf and the inverter module 11, unlike the first embodiment in which the switching section 13 is connected in series between the inverters 11 and 12. The operation of this embodiment is similar to that of the first embodiment.

Figure 5A:
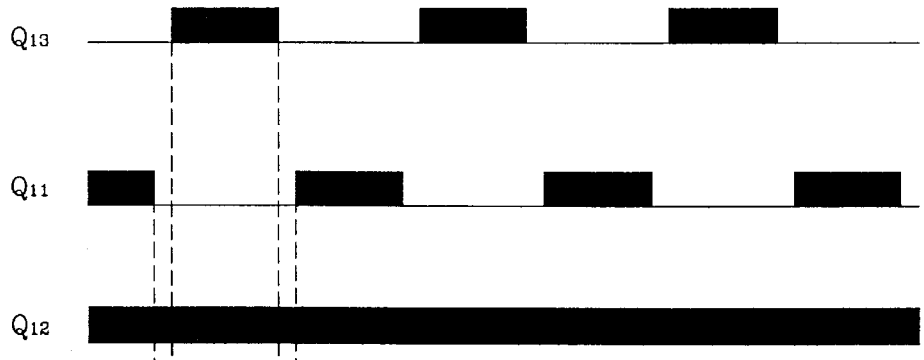
FIG. 5A illustrates the on/off switching waveform of the switching elements in FIG. 4 when the working coil L11 operates.
Figure 5B:
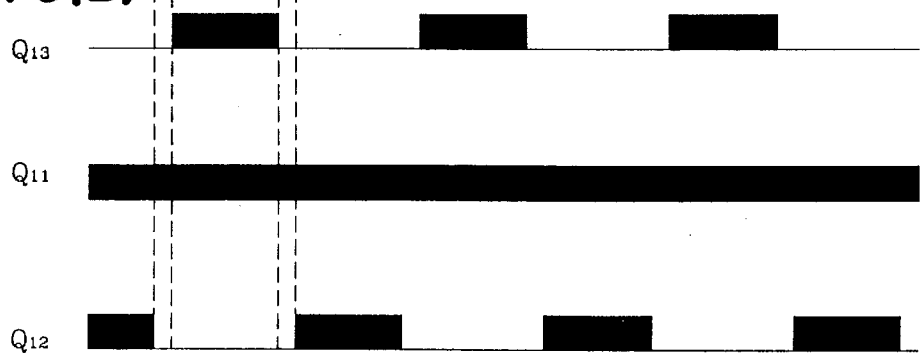
FIG. 5B illustrates the on/off switching waveform of the switching elements in FIG. 4 when the working coil L12 operates.

FIGS. 5A and 5B illustrate the switching waveform of the switching elements for the operation of the second embodiment.

Figure 6:
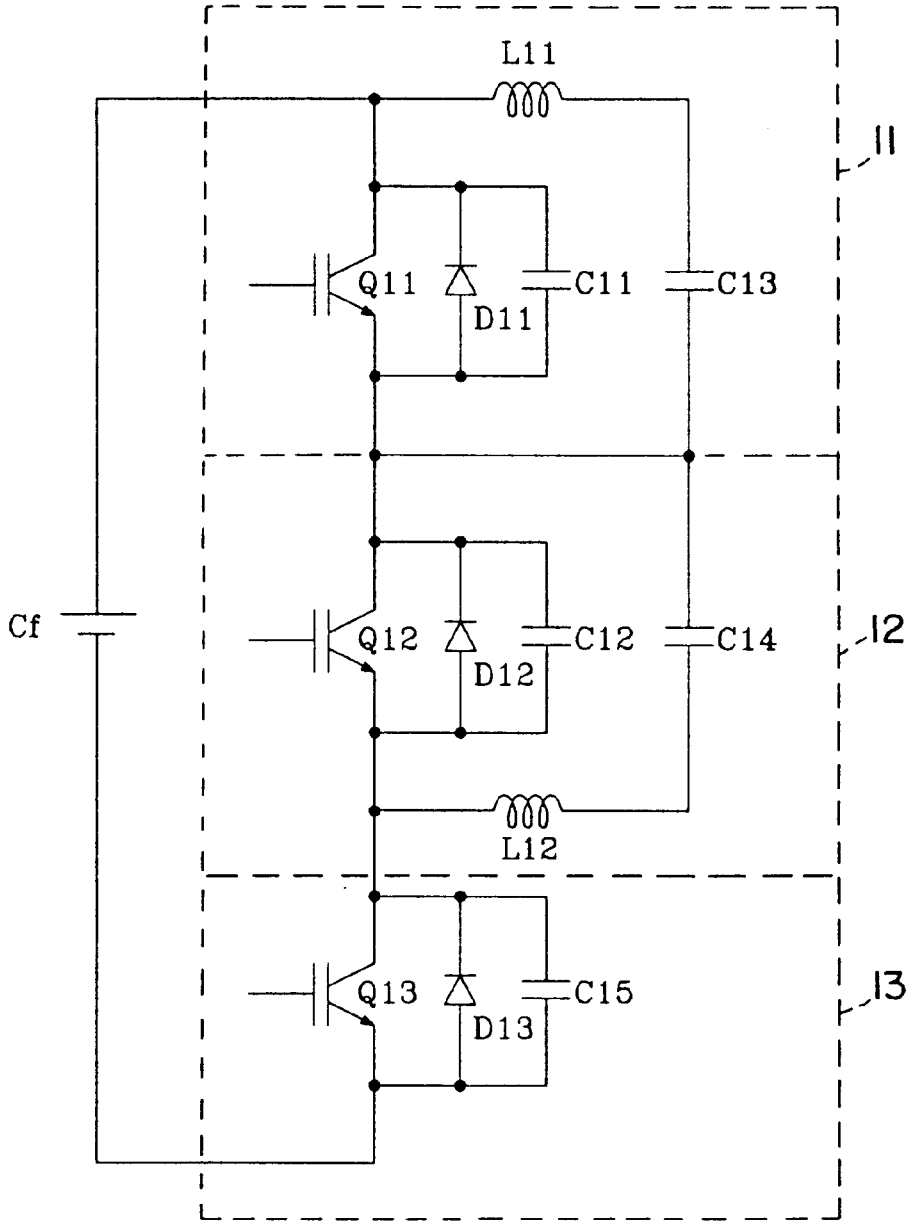
FIG. 6 is a schematic circuit diagram according to the third embodiment of the present invention.
Figure 7A:
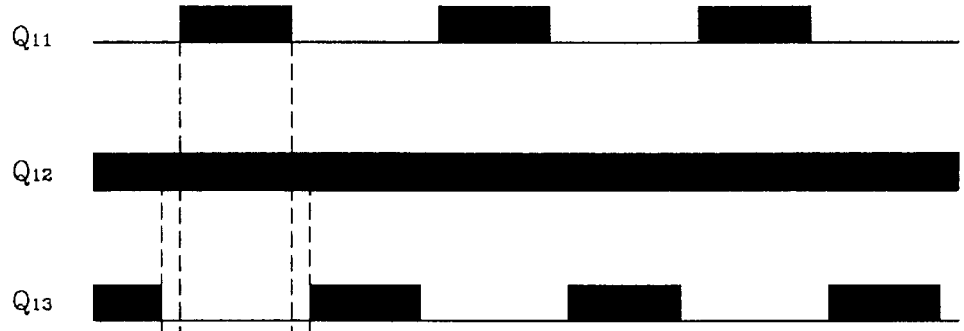
FIG. 7A illustrates the on/off switching waveform of the switching elements in FIG. 6 when the working coil L11 operates.
Figure 7B:
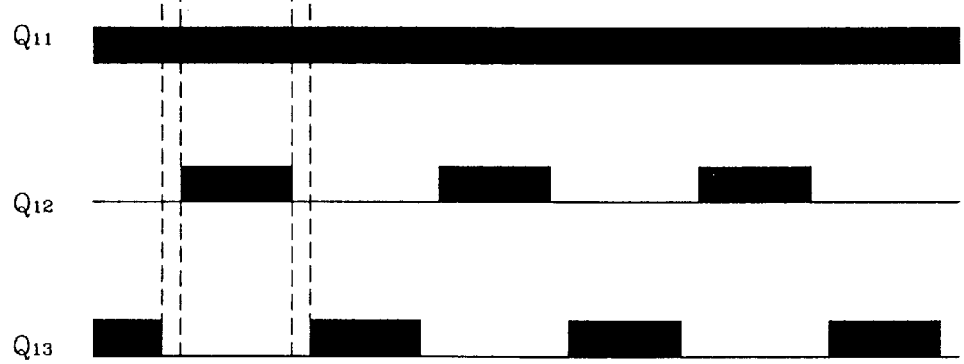
FIG. 7B illustrates the on/off switching waveform of the switching elements in FIG. 6 when the working coil L12 operates.

FIG. 6 is a circuit diagram of the third embodiment according to the present invention. In the third embodiment, the switching section 13 is directly connected to the input filter capacitor Cf and the inverter module 12. The operation of this embodiment is similar to those of the first embodiment and the second embodiment. FIGS. 7A and 7B illustrates the switching waveform of the switching elements for the operation of the third embodiment.

As shown in FIGS. 3A–3B, 5A–5B and 7A–7B, the switching waveforms are slightly different based on the positions of the switching section 13, but their operations are similar.

Figure 8:
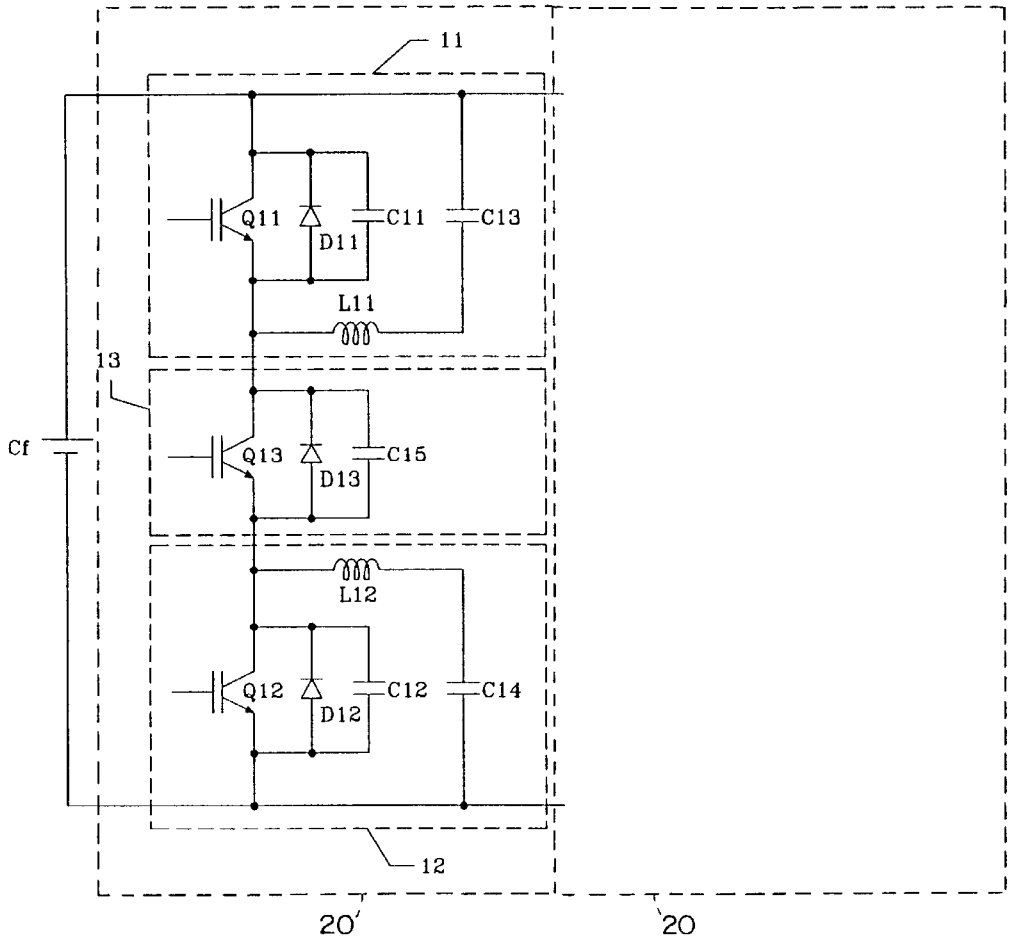

FIG. 8 is a circuit diagram of the dual half-bridge type induction cooking apparatus according to the fourth embodiment of the present invention.

In the fourth embodiment, two half-bridge type inverter circuits 20 are connected in parallel to the input filter capacitor Cf.

Figure 3B:
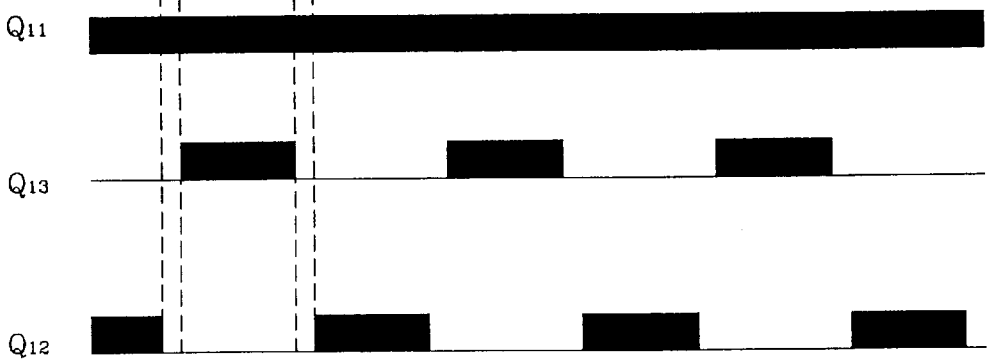
FIG. 3B illustrates the on/off switching waveform of the switching elements in FIG. 2 when the working coil L12 operates.

The operation of each half-bridge type inverter circuit 20 is the same as the half-bridge inverter circuit 20 of FIG. 2, and the switching waveform of the switching elements are the same as shown in FIGS. 3A–3B; albeit differing in timing if so desired.

Accordingly, four heating plates are heated simultaneously or separately. In further alternative embodiments, two half-bridge type inverter circuits such as illustrated in FIGS. 4 and 6 may also be connected in parallel with the input filter capacitor Cf.

Figure 9:
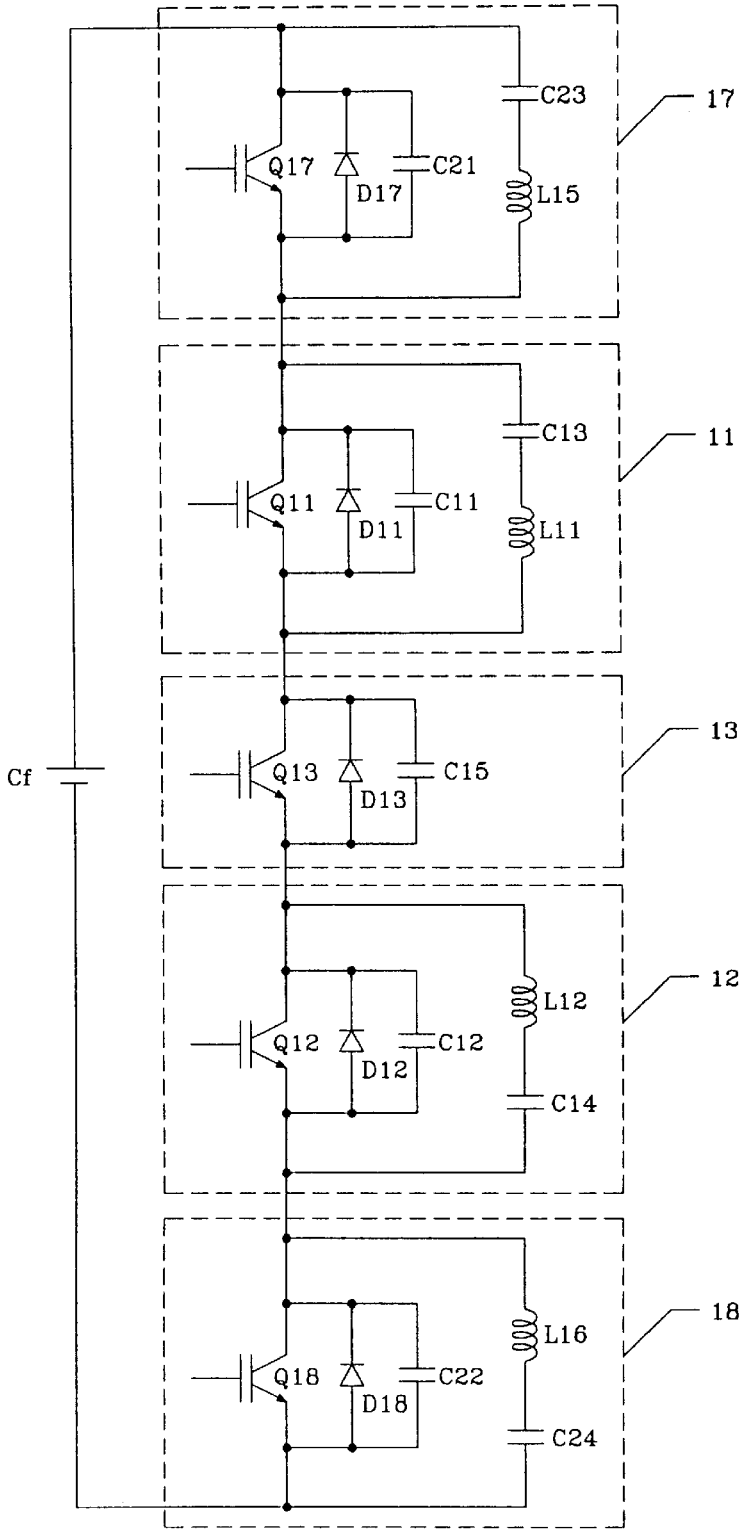
FIG. 9 is a schematic circuit diagram according to the fifth embodiment of the present invention.

FIG. 9 is a circuit diagram of the dual half-bridge type induction cooking apparatus according to the fifth embodiment of the present invention to operate four heating plates.

In the fifth embodiment, the inverter modules 17 and 18 are connected to the inverter modules 11 and 12 in series. The inverter modules 11, 12, 17 and 18 and the common switching section 13 form the half-bridge type inverter. The working coils L11, L12, L15 and L16 in each respective module is operated by the half-bridge type inverter.

Figure 10A:
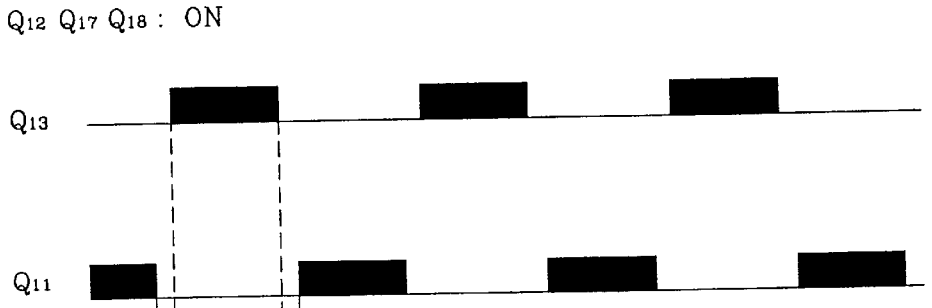
FIG. 10A illustrates the on/off switching waveform of the switching elements in FIG. 9 when the working coil L11 operates.
Figure 10B:
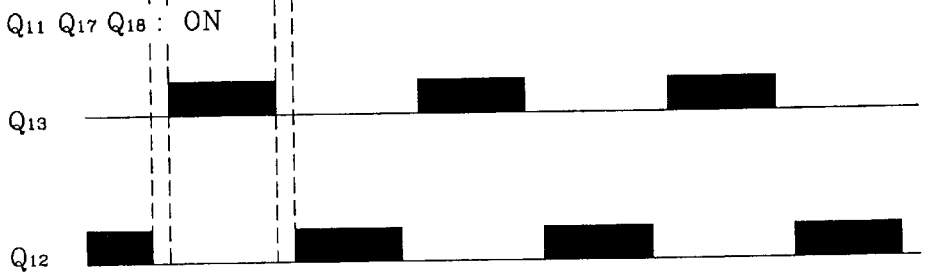
FIG. 10B illustrates the on/off switching waveform of the switching elements in FIG. 9 when the working coil L12 operates.

FIG. 10A illustrates the switching waveform of the switching elements in the fifth embodiment when the working coil L11 is operated and FIG. 10B illustrates the switching waveform when the working coil L12 is operated.

The operation of the fifth embodiment also is the same as those of the above-described embodiments. For the operation of the working coil L11, when the inverter modules 11, 12, 17 and 18 are operated, as shown in FIG. 10A, the transistors Q12, Q17 and Q18 should be always turned on. For the operation of the working coil L12, as shown in FIG. 10B, the transistors Q11, Q17 and Q18 should be turned on. In other words, the inverter modules other than the inverter module and the switching section 13 to be operated should be turned on.

Both the fourth embodiment and the fifth embodiment can operate four heating plates, but in the fifth embodiment, the heating plates are operated by the four inverter modules having a common switching section 13 and in the fourth embodiment, one common switching section 13 is added since two additional switching sections 11 and 12 are required.

However, in case of the fifth embodiment, all switching elements of the inverter modules other than the inverter module and the switching section 13 to be operated should be turned on. Thus, the fourth embodiment has an advantage in switching loss.

From the foregoing, it will be apparent that the dual half-bridge type induction cooking apparatus according to the present invention provides the advantages in that it can prevent the interference noise when a plurality of heating plates are operated simultaneously, by providing the half-bridge type inverter composed of the common switching element and the inverter circuits in module unit, and operating a plurality of the working coils in a time-shared manner by a inverter circuit.

While the present invention has been described and illustrated herein with reference to the preferred embodiments thereof, it will be understood by those skilled in the art that various changes in form and details may be made therein without departing from the spirit and scope of the invention.

What is claimed is:

1. An induction cooking apparatus, comprising:

an input filter for filtering supplied power;

a first inverter module having a first working coil;

a second inverter module having a second working coil; and a common switching section, said common switching section and said first and second inverter modules connected in series with said input filter, said first and second inverter modules operating cooperatively with said common switching section to energize said first and second working coils.

2. The apparatus of claim 1, wherein said first and second inverter modules operate cooperatively with said common switching section such that said first and second working coils are not energized simultaneously.

3. The apparatus of claim 1, wherein said first inverter module includes a first switching element and at least one resonance capacitor connected to said first working coil;

said second inverter module includes a second switching element and at least one resonance capacitor connected to said second working coil; and said common switching section includes a third switching element.

4. The apparatus of claim 1, wherein said common switching section is connected in series between said first and second inverter modules.

5. The apparatus of claim 1, wherein said common switching section is connected in series between said input filter and said first inverter module.

6. The apparatus of claim 1, wherein said common switching section is connected in series between said second inverter module and said input filter.

7. The apparatus of claim 1, wherein said common switching section, said first inverter module and said second inverter module form a first inverter circuit; and a second inverter circuit is connected to said input filter in a parallel with said first inverter circuit.

8. The apparatus of claim 7, wherein in each of said first and second inverter circuits, said first and second inverter modules operate cooperatively with said common switching section such that said first and second working coils arc not energized simultaneously.

9. The apparatus of claim 1, further comprising:

third and fourth inverter modules connected in series with said first inverter module, said second inverter module, said common switching section and said input filter, said third and fourth inverter modules including third and fourth working coils, respectively, said third and fourth inverter modules operating cooperatively with said common switching section to energize said third and fourth working coils, respectively.

10. The apparatus of claim 9, wherein said first, second, third and fourth inverter modules operate cooperatively with said common switching section such that said first, second, third and fourth working coils are not energized simultaneously.

11. The apparatus of claim 9, wherein said third inverter module is connected in series between said input filter and said first inverter module;

said fourth inverter module is connected in series between said input filter and said second inverter module; and said common switching section is connected in series between said first and second inverter modules.

* * * * *